US012577892B2

(12) United States Patent
Andrisani et al.

(10) Patent No.: US 12,577,892 B2
(45) Date of Patent: Mar. 17, 2026

(54) HYDRAULIC LASH ADJUSTMENT-COMPATIBLE ENGINE BRAKING SYSTEM WITH GUIDED BRIDGE ARRANGEMENT

(71) Applicant: Eaton Intelligent Power Limited, Dublin (IE)

(72) Inventors: Nicola Andrisani, Cumiana (IT); Vikram Deokar, Pune (IN); Ketaki Purkar, Dhule (IN); Alessandro Roscioli, Chieri (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/899,963

(22) Filed: Sep. 27, 2024

(65) Prior Publication Data

US 2025/0020071 A1 Jan. 16, 2025

Related U.S. Application Data

(63) Continuation of application No. PCT/EP2023/025143, filed on Mar. 30, 2023.

(30) Foreign Application Priority Data

Mar. 30, 2022 (IN) ..... 202211018866

(51) Int. Cl.
*F01L 1/24* (2006.01)
*F01L 13/06* (2006.01)

(52) U.S. Cl.
CPC ..... *F01L 1/2411* (2013.01); *F01L 13/06* (2013.01)

(58) Field of Classification Search
CPC ... F01L 1/2411; F01L 13/06; F01L 2001/186; F01L 2013/105; F01L 1/24; F01L 1/2416; F01L 1/267; F01L 13/065
See application file for complete search history.

(56) References Cited

U.S. PATENT DOCUMENTS 7,921,818 B2 4/2011 Rauch
8,225,769 B2 7/2012 Dilly
(Continued)

FOREIGN PATENT DOCUMENTS

CN 101392667 A * 3/2009 ..... F01L 13/065
CN 102102559 A * 6/2011 ..... F01L 13/06
(Continued)

OTHER PUBLICATIONS

International search report and Written Opinion received for PCT Application No. PCT/EP2023/025143, 12 pages.

*Primary Examiner* — Hung Q Nguyen
(74) *Attorney, Agent, or Firm* — Baker Botts L.L.P.

(57) ABSTRACT

An added-motion engine braking system selectively operable in an engine braking mode and a drive mode and compatible with providing hydraulic lash adjustment includes an exhaust rocker arm assembly, a main exhaust valve and a brake valve, a valve bridge configured to selectively act on the main exhaust valve and the brake valve and constrained to move parallel to a valve opening direction, a hydraulic lash adjuster disposed on the exhaust rocker arm assembly and configured to automatically compensate for lash between the exhaust rocker arm assembly and the valve bridge; and an engine braking rocker arm assembly configured to selectively act on the brake valve in the engine brake mode, wherein, in a base circle position with the main exhaust valve and the brake valve closed, the valve bridge is configured to preferentially contact the main exhaust valve compared to the brake valve.

20 Claims, 3 Drawing Sheets

(56) References Cited

U.S. PATENT DOCUMENTS

| | | | | |
|---|---|---|---|---|
| 10,626,763 | B2 | 4/2020 | Jo | |
| 11,092,042 | B2 | 8/2021 | McCarthy | |
| 2008/0006231 | A1 | 1/2008 | Noss | |
| 2014/0083381 | A1* | 3/2014 | Roberts | F01L 1/08 123/90.15 |
| 2017/0321576 | A1* | 11/2017 | Nielsen | F01L 13/06 |
| 2019/0145289 | A1* | 5/2019 | Ferreira | F01L 13/065 123/90.55 |
| 2019/0257228 | A1* | 8/2019 | Xi | F01L 13/065 |

FOREIGN PATENT DOCUMENTS

| | | | | | |
|---|---|---|---|---|---|
| CN | 103597174 | A | * | 2/2014 | F02D 13/04 |
| EP | 2305967 | A1 | * | 4/2011 | F01L 1/26 |
| EP | 3146185 | B1 | * | 4/2020 | F02D 13/04 |
| WO | WO-2016174493 | A1 | * | 4/2011 | F01L 1/267 |
| WO | WO-2012083574 | A1 | * | 6/2012 | F01L 13/065 |
| WO | WO 2017177102 | A1 | | 10/2017 | |

* cited by examiner

10

HYDRAULIC LASH ADJUSTMENT-COMPATIBLE ENGINE BRAKING SYSTEM WITH GUIDED BRIDGE ARRANGEMENT

PRIORITY

This application is a continuation under 35 U.S.C. § 365 (c) of International Patent Application No. PCT/EP2023/025143, filed on 30 Mar. 2023, which claims the benefit under 35 U.S.C. § 119 (a) of Indian application No. 202211018866, filed 30 Mar. 2022, all of which are incorporated herein by reference.

TECHNICAL FIELD

The present disclosure relates generally to mechanisms for providing an engine brake function, and more particularly to mechanisms, assemblies, arrangements, and methods that enable engine braking using a dedicated engine braking rocker.

BACKGROUND

Engine brakes may be used as auxiliary brakes, in addition to wheel brakes, on vehicles. Particular engine braking implementation approaches may involve compression release engine braking, or bleeder engine braking. Engine braking methodologies may be based on a selective opening of exhaust valves, wherein a subset of exhaust valves may be designated for implementing an engine braking function. For instance, for engines featuring two exhaust valves per cylinder, one of the two exhaust valves may be designated as a brake valve for implementing engine braking.

Particular engine braking assemblies may employ integrated rocker arm assemblies that may handle the combined selective operation of brake valves and main exhaust valves across different engine modes. Other particular engine braking assemblies may employ separate or dedicated rocker arm assemblies to perform specialized functions, which may be activated in particular engine modes, and/or may selectively operate specific exhaust valves of the full set of exhaust valves provided per cylinder of the engine.

The description provided herein is for the purpose of generally presenting the context of the disclosure. Work of the presently named inventors, to the extent it is described in this section, as well as aspects of the description that cannot otherwise qualify as prior art at the time of filing, are neither expressly nor impliedly admitted as prior art against the present disclosure.

SUMMARY OF PARTICULAR EMBODIMENTS

In particular embodiments, an added-motion engine braking system is disclosed that is selectively operable in at least an engine braking mode and a drive mode, the engine braking system being compatible with providing hydraulic lash adjustment, the engine braking system comprising an exhaust rocker arm assembly; a main exhaust valve and a brake valve; a valve bridge configured to selectively act on the main exhaust valve and the brake valve based on the exhaust rocker arm assembly acting on the valve bridge, a motion of the valve bridge constrained to be parallel to a valve opening direction; a hydraulic lash adjuster disposed on the exhaust rocker arm assembly and configured to selectively extend to automatically compensate for lash between the exhaust rocker arm assembly and the valve bridge; and a dedicated engine braking rocker arm assembly configured to selectively act on the brake valve in the engine brake mode, wherein, in a base circle position with the main exhaust valve and the brake valve closed, the valve bridge is configured to preferentially contact the main exhaust valve compared to the brake valve.

In particular embodiments, which may combine the features of some or all above embodiments, in the base circle position with the main exhaust valve and the brake valve closed, a gap along the valve opening direction is provided between the valve bridge and the brake valve to facilitate preferential contact of the valve bridge with the main exhaust valve.

In particular embodiments, which may combine the features of some or all above embodiments, the valve bridge comprises a guiding member provided coaxially within the valve bridge and disposed parallel to the valve opening direction.

In particular embodiments, which may combine the features of some or all above embodiments, the engine braking system further comprises a bridge socket slidably disposed within a bore of the valve bridge and configured to enable access to the brake valve by the engine braking rocker arm assembly.

In particular embodiments, which may combine the features of some or all above embodiments, in the base circle position with the main exhaust valve and the brake valve closed, at least one gap along the valve opening direction is provided to facilitate preferential contact of the valve bridge with the main exhaust valve, the at least one gap provided at a first interface disposed between the valve bridge and the bridge socket, or at a second interface disposed between the bridge socket and the brake valve, or at both the first interface and the second interface.

In particular embodiments, which may combine the features of some or all above embodiments, in the engine brake mode, the valve bridge and the hydraulic lash adjuster are kinematically decoupled from a brake valve operation of the engine braking rocker arm assembly.

In particular embodiments, which may combine the features of some or all above embodiments, the hydraulic lash adjuster is longitudinally aligned with a center of the valve bridge.

In particular embodiments, which may combine the features of some or all above embodiments, a method of configuring an added-motion engine braking system to enable automatic hydraulic lash adjustment is disclosed, the method comprising constraining a motion of a valve bridge to be parallel to a valve opening direction, the valve bridge configured to selectively act on a main exhaust valve and a brake valve based on an exhaust rocker arm assembly acting on the valve bridge; configuring a hydraulic lash adjuster disposed on the exhaust rocker arm assembly to selectively extend to automatically compensate for lash between the exhaust rocker arm assembly and the valve bridge; configuring, in a base circle position with the main exhaust valve and the brake valve closed, the valve bridge to preferentially contact the main exhaust valve relative to the brake valve; and configuring an engine braking rocker arm assembly to selectively act on the brake valve in an engine brake mode, the engine braking rocker arm assembly provided separately from the exhaust rocker arm assembly.

In particular embodiments, which may combine the features of some or all above embodiments, preferential contact of the valve bridge with the main exhaust valve is facilitated by providing a gap along the valve opening direction between the valve bridge and the brake valve.

In particular embodiments, which may combine the features of some or all above embodiments, the valve bridge comprises a guiding member provided coaxially within the valve bridge and disposed parallel to the valve opening direction.

In particular embodiments, which may combine the features of some or all above embodiments, a method of configuring an added-motion engine braking system to enable automatic hydraulic lash adjustment further comprises configuring a bridge socket to enable access to the brake valve by the engine braking rocker arm assembly, the bridge socket slidably disposed within a bore of the valve bridge.

In particular embodiments, which may combine the features of some or all above embodiments, preferential contact of the valve bridge with the main exhaust valve is facilitated by providing at least one gap along the valve opening direction at a first interface disposed between the valve bridge and the bridge socket, or at a second interface disposed between the bridge socket and the brake valve, or at both the first interface and the second interface.

In particular embodiments, which may combine the features of some or all above embodiments, the valve bridge and the hydraulic lash adjuster are kinematically decoupled from a brake valve operation of the engine braking rocker arm assembly in the engine brake mode.

In particular embodiments, which may combine the features of some or all above embodiments, a method of configuring an added-motion engine braking system to enable automatic hydraulic lash adjustment further comprises longitudinally aligning the hydraulic lash adjuster with a center of the valve bridge.

In particular embodiments, which may combine the features of some or all above embodiments, a valvetrain system of an engine is disclosed, the valvetrain system capable of selectively engaging an engine braking enabled mode and a drive mode, the valvetrain system comprising an exhaust camshaft provided with a main exhaust cam and a braking cam; an exhaust valve rocker arm assembly operatively coupled with the main exhaust cam of the exhaust camshaft; a main exhaust valve and a brake valve; a valve bridge configured to selectively act on the main exhaust valve and the brake valve based on the exhaust rocker arm assembly acting on the valve bridge, a motion of the valve bridge constrained to be parallel to a valve opening direction; a hydraulic lash adjuster disposed on the exhaust rocker arm assembly and configured to selectively extend to automatically compensate for lash between the exhaust rocker arm assembly and the valve bridge; and an engine braking rocker arm assembly provided separately from the exhaust rocker arm assembly, the engine braking rocker arm operatively coupled with the braking cam of the exhaust camshaft and configured to selectively act on the brake valve in the engine brake mode, wherein, in a base circle position with the main exhaust valve and the brake valve closed, the valve bridge is configured to preferentially contact the main exhaust valve compared to the brake valve.

In particular embodiments, which may combine the features of some or all above embodiments, in the base circle position with the main exhaust valve and the brake valve closed, a gap along the valve opening direction is provided between the valve bridge and the brake valve to facilitate preferential contact of the valve bridge with the main exhaust valve.

In particular embodiments, which may combine the features of some or all above embodiments, the valve bridge comprises a guiding member provided coaxially within the valve bridge and disposed along the valve opening direction.

In particular embodiments, which may combine the features of some or all above embodiments, the valvetrain system further comprises a bridge socket slidably disposed within a bore of the valve bridge and configured to enable access to the brake valve by the engine braking rocker arm assembly.

In particular embodiments, which may combine the features of some or all above embodiments, in the base circle position with the main exhaust valve and the brake valve closed, at least one gap along the valve opening direction is provided to facilitate preferential contact of the valve bridge with the main exhaust valve, the at least one gap provided at a first interface disposed between the valve bridge and the bridge socket, or at a second interface disposed between the bridge socket and the brake valve, or at both the first interface and the second interface.

In particular embodiments, which may combine the features of some or all above embodiments, in the engine brake mode, the valve bridge and the hydraulic lash adjuster are kinematically decoupled from a brake valve operation of the engine braking rocker arm assembly.

BRIEF DESCRIPTION OF THE DRAWINGS

The present invention will be described in greater detail below based on the exemplary figures. The invention is not limited to the exemplary embodiments. Other features and advantages of various embodiments of the present invention will become apparent by reading the following detailed description with reference to the attached drawings which illustrate the following.

Figure 1:
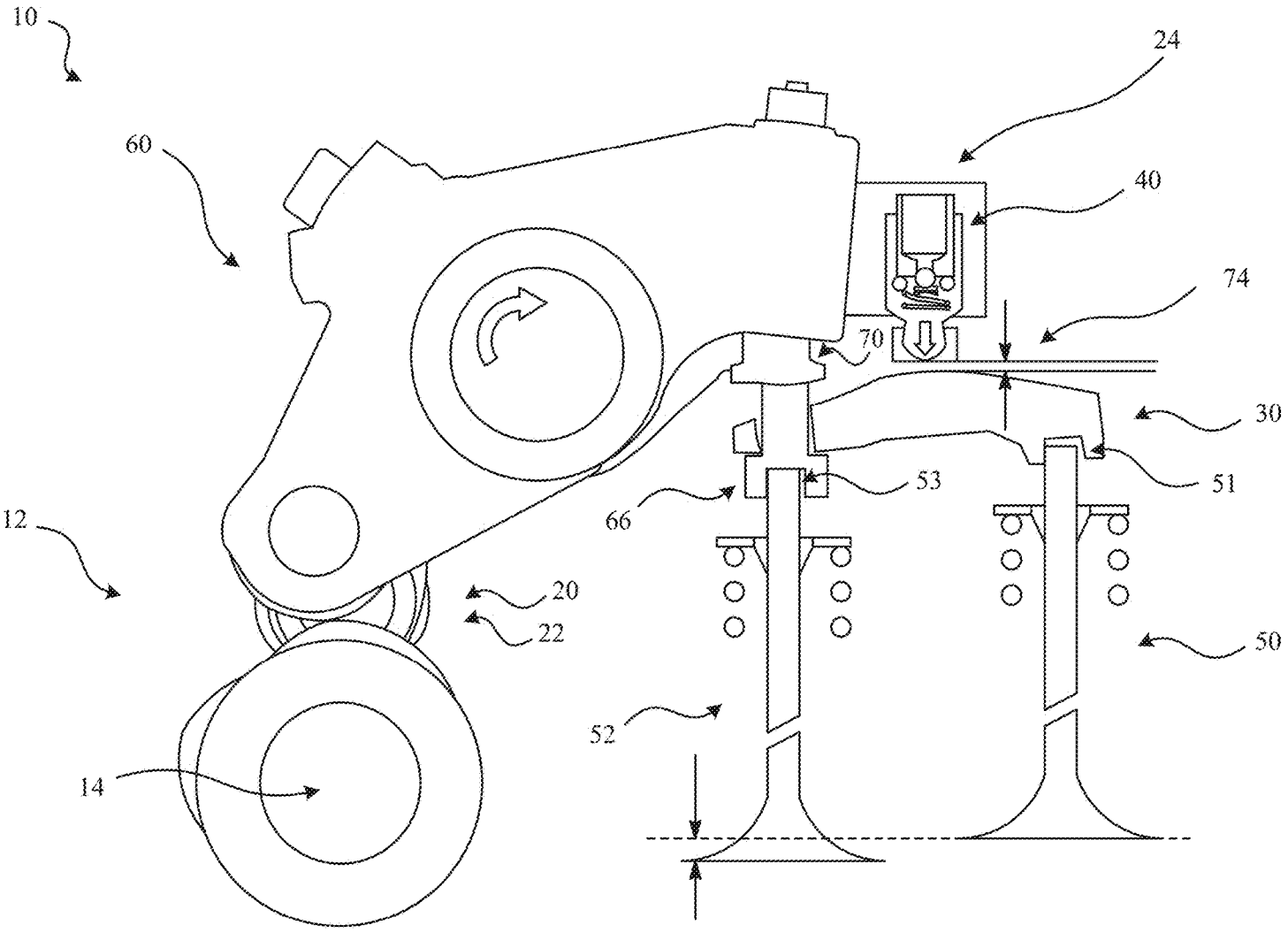
FIG. 1 illustrates a schematic view of a valvetrain assembly having a dedicated engine braking rocker arm, according to particular embodiments.

It should be noted that figures provided may be illustrated schematically rather than literally or precisely; components and aspects of the figures may also not necessarily be to scale. Moreover, while like reference numerals may designate corresponding parts throughout the different views in many cases, like parts may not always be provided with like reference numerals in each view.

DESCRIPTION OF EXAMPLE EMBODIMENTS

In accordance with various embodiments of the present disclosure, engine braking assemblies and related mechanisms, devices, arrangements, and methods are provided herein. For clarity, not all features of each actual implementation or embodiment may be described in this specification. Additionally, some aspects and features may be described at a high level. Further, features and aspects that are disclosed, illustrated, and/or apparently otherwise contemplated in certain specific configurations are fully contemplated to be mixed or combined to produce any and all resulting configurations using features and aspects from any embodiments and/or configurations considered herein. Thus, modifications, variations, adaptations, and/or combinations of features and aspects may be made that result in embodiments that are fully contemplated to fall within the scope of this disclosure.

In particular embodiments, an engine braking function may be provided by selectively operating one or more exhaust valves that may be specifically designated for engine braking based on using a separate or dedicated mechanism, such as a dedicated engine braking rocker arm. In particular embodiments, by way of illustration and not limitation, a dedicated engine braking rocker arm may comprise an added-motion mechanism, so called as it may introduce, add, and/or superimpose additional aspects of valve-operating motion to existing base motions when activated, as opposed to so called lost-motion mechanisms, which may subtract, remove, and/or absorb particular aspects from base motions when activated, such as using lost motion mechanisms.

As a non-limiting example, particular rocker arm assemblies that may integrate the selective operation of main exhaust valves and brake valves, based on selecting an engine brake mode or (non-engine braking) drive mode, into a single integrated rocker arm may employ one or more lost motion mechanism to absorb specific valve lift(s) received and selectively transmit other valve lift(s), based on mode selection.

In particular embodiments comprising dedicated engine braking mechanisms, such as a dedicated and/or added-motion engine braking rocker arm, there may be challenges to integrating or otherwise making compatible hydraulic lash adjustment (HLA) mechanisms. Inventive mechanisms and arrangements will be further discussed herein to enable integration and/or compatibility of HLA mechanisms in valvetrain systems employing dedicated and/or added-motion engine braking mechanisms.

FIG. 1 illustrates a schematic view of a valvetrain assembly 10 having a dedicated engine braking rocker arm 60, according to particular embodiments.

In particular embodiments, an engine cylinder may be provided with multiple exhaust valves, a subset of which exhaust valves may be particularly designated for providing an engine braking function. In particular embodiments, one or more exhaust valves that may be operated for implementing engine braking may be called brake valves; the remaining exhaust valves may be called main exhaust valves. In particular embodiments, such as a non-limiting example illustrated in FIG. 1, an engine cylinder may comprise two exhaust valves: a main exhaust valve 50, and a brake valve 52. In particular embodiments, both exhaust valves 50 and 52 may be selectively operated in combination and/or in tandem during normal engine operation in a drive mode, wherein engine braking may be disabled. In particular embodiments, brake valve 52 may be specifically operated to provide an engine braking function in an engine braking mode, wherein engine braking may be enabled.

In particular embodiments, valvetrain assembly 10 may comprise a main exhaust rocker arm 20. As illustrated in the frame of reference of FIG. 1, partial schematic aspects of main exhaust rocker arm 20 may be visible; main rocker arm is located in a plane behind engine braking rocker arm 60 relative to the viewer, in the frame of reference of FIG. 1.

In particular embodiments, main exhaust rocker arm 20 may comprise a cam end 22 and a valve end 24. In particular embodiments, cam end 22 of main exhaust rocker arm 20 may directly or indirectly receive one or more exhaust valve lift profiles from one or more exhaust valve cams provided on camshaft 14. In particular embodiments, valve end 24 of main exhaust rocker arm 20 may act on, influence, and/or otherwise selectively operate both exhaust valves 50 and 52, such as via a valve bridge 30, based on valve lift received by cam end 22.

In particular embodiments, main exhaust rocker arm 20 may rotate clockwise (in the frame of reference of FIG. 1) based on exhaust valve lift received at cam end 22, so as to directly or indirectly act on, operate, and/or otherwise influence one or more exhaust valves to open, while the received exhaust valve lift may increase from a minimum base circle value based on rotation of camshaft 14. Subsequently in the engine cycle, main exhaust rocker arm 20 may rotate counter-clockwise (again, in the frame of reference of FIG. 1) as received valve lift may decrease back to a minimum base circle cam lift value, correspondingly closing the one or more exhaust valves that may be acted on, operated, and/or otherwise influenced by valve end 24 of main exhaust rocker arm 20, based on continuing rotation of camshaft 14 through the engine cycle.

In particular embodiments, valve end 24 of main exhaust rocker arm 20 may be provided with a hydraulic lash adjustment mechanism, such as hydraulic lash adjuster (HLA) 40. In particular embodiments, hydraulic lash adjuster 40 may provide automatic compensation for lash between an interfacing surface between valve end 24 of main exhaust rocker arm 20 and valve bridge 30. As a non-limiting example, hydraulic lash adjuster 40 may be configured to selectively expand and/or extend to close and/or eliminate mechanical lash, such as a gap that may otherwise exist between valve end 24 of main exhaust rocker arm 20 (such as at HLA plunger 47) and valve bridge 30 (such as at exhaust rocker interface 48). Separately or additionally, hydraulic lash adjuster 24 may be configured to collapse or close as needed, to ensure intended operation, such as enabling one or more engine valves that may be intended to fully close to do so as and when intended. As a non-limiting example, such a lash adjustment or compensation may be desirable under particular conditions to enable safe, efficient, and/or reliable engine operation, and/or to ensure appropriate valve timing, valve opening and/or valve closing operation. Such a lash adjustment or compensation may be necessitated in particular embodiments based on potential relative and absolute thermal expansions, tolerances, wear and tear, and/or other effects and variabilities. Additional operational details and features of particular embodiments of HLA 40 are provided herein in a later section.

Contrary to the above description, a gap 74 between HLA 40 and valve bridge 30 is illustrated in FIG. 1, and may be used herein to describe particular aspects of operation and/or particular inventive embodiments.

In particular embodiments, a separate or dedicated engine braking rocker arm 60 may be provided, which may be selectively operated in an engine braking mode. In particular embodiments, engine braking rocker arm 60 may directly or indirectly act on, operate, and/or otherwise specifically influence brake valve 52 to selectively open in an engine braking mode.

As a non-limiting illustrative example, engine braking rocker arm 60 may be selectively activated in an engine braking mode, wherein it may rotate clockwise (in the frame of reference of FIG. 1) based on receiving a brake valve lift profile by engagement with a corresponding cam, to open brake valve 52 while the brake lift increases from a minimum base circle value of the corresponding cam. Subsequently, engine braking rocker arm 60 may rotate counterclockwise (in the frame of reference of FIG. 1) to close brake valve 52 as received valve lift may decrease back to a minimum base circle value through the engine cycle.

In particular embodiments, based on motion of the engine braking rocker arm 60 corresponding to received brake valve lift, engine braking rocker arm 60 may act on brake valve 52 via a plunger 70. In particular embodiments, one or more members, such as a pin, piston, or socket, such as bridge socket 66, may be provided to enable plunger 70 to access brake valve 52 within valve bridge 30. In particular embodiments, bridge socket 66 may enable brake valve 52 to be accessed by engine braking rocker arm 60 via plunger 70, such as in an engine braking mode, while brake valve 52 may still be operable by exhaust rocker arm 20 via valve bridge 30, such as in a drive mode. As a non-limiting example, bridge socket 66 may be provided within a bore of valve bridge 30, and/or may be capable of sliding or translating within valve bridge 30. In particular embodiments, plunger 70 may be longitudinally aligned with bridge socket 66.

In FIG. 1, several profiles of cams 12 are illustrated in the view provided, particular ones of which cams may correspondingly engage with particularly configured receiving aspect(s) of the main exhaust rocker arm 20 and engine braking rocker arm 60.

It should be appreciated that while particular mechanisms for engine braking operations (such as engine braking rocker arm 60) may be illustrated herein, this disclosure fully contemplates all suitable mechanisms for enabling engine braking operation. In particular embodiments, brake valve 52 may be operated to be selectively held open by any suitable dedicated engine braking mechanism through parts or whole engine cycles during an engine braking mode. In particular embodiments, separate or additional mechanisms than a rocker arm may be used to selectively open brake valve 52 during engine braking. Further, it should be appreciated for the purposes of illustration and sufficient disclosure of inventive aspects and embodiments disclosed herein that a plunger 70 or similar extending or extendable member may be continue to be considered an equivalent interfacing member of any other engine braking mechanism for selective brake valve opening, even if plunger 70 may not be illustrated herein as coupled to said other mechanism.

It may be challenging to integrate, operate, and/or otherwise make compatible an operational use of hydraulic lash adjustment systems in valvetrain systems that may also feature dedicated engine braking mechanisms. As a non-limiting illustrative example, in particular embodiments, in a base circle position with both main exhaust and braking valves 50 and 52 closed, valve bridge 30 may be disposed in a level and/or horizontal orientation (not shown in FIG. 1 in this configuration or setting). By way of illustration and not limitation, such a level and/or horizontal orientation may be based on valve bridge 30 essentially "resting" on both main exhaust and braking valves 50 and 52 in a base circle position with both valves closed, such that mutual and simultaneous effective contact of valve bridge 30 with both valves 50 and 52 at their respective contact sockets 51 and 53, respectively, may be achieved. In this level and/or horizontal configuration of valve bridge 30, HLA 40 may be appropriately or desirably extended to overcome an initial lash, such as at exhaust rocker interface 48. Subsequently, if engine braking rocker arm 60 were to operate in an engine braking mode to act upon and open brake valve 52 (as illustrated in FIG. 1), a force and/or moment may asymmetrically act on valve bridge 30 based on contact and/or relative motion between brake valve 52, bridge socket 66, and/or valve bridge 30, such that valve bridge 30 may tilt and at least momentarily open up a gap 74 between HLA 40 and valve bridge 30, in particular embodiments. In particular embodiments in this situation, based on normal operating principles of HLA 40 as described above, HLA 40 may then automatically extend or otherwise act to overcome gap 74, which may then introduce an offset and/or tilt in valve bridge 30 corresponding to the now-overcome gap 74. Such an extension, offset, and/or tilt of valve bridge 30 may be undesirable for subsequent correct operation of valvetrain assembly 10. As a non-limiting example, such an extension, offset and/or tilt of valve bridge 30 corresponding to a gap 74 subsequently and undesirably overcome by HLA 40 may prevent one or more exhaust valves from closing completely, may affect valve timing, and/or otherwise affect desired valve operation, during an engine cycle. Thus, in particular embodiments, preventing tilting of valve bridge 30 may be an important first objective toward successful operational integration of HLA 40 in such a mechanism.

Figure 2:
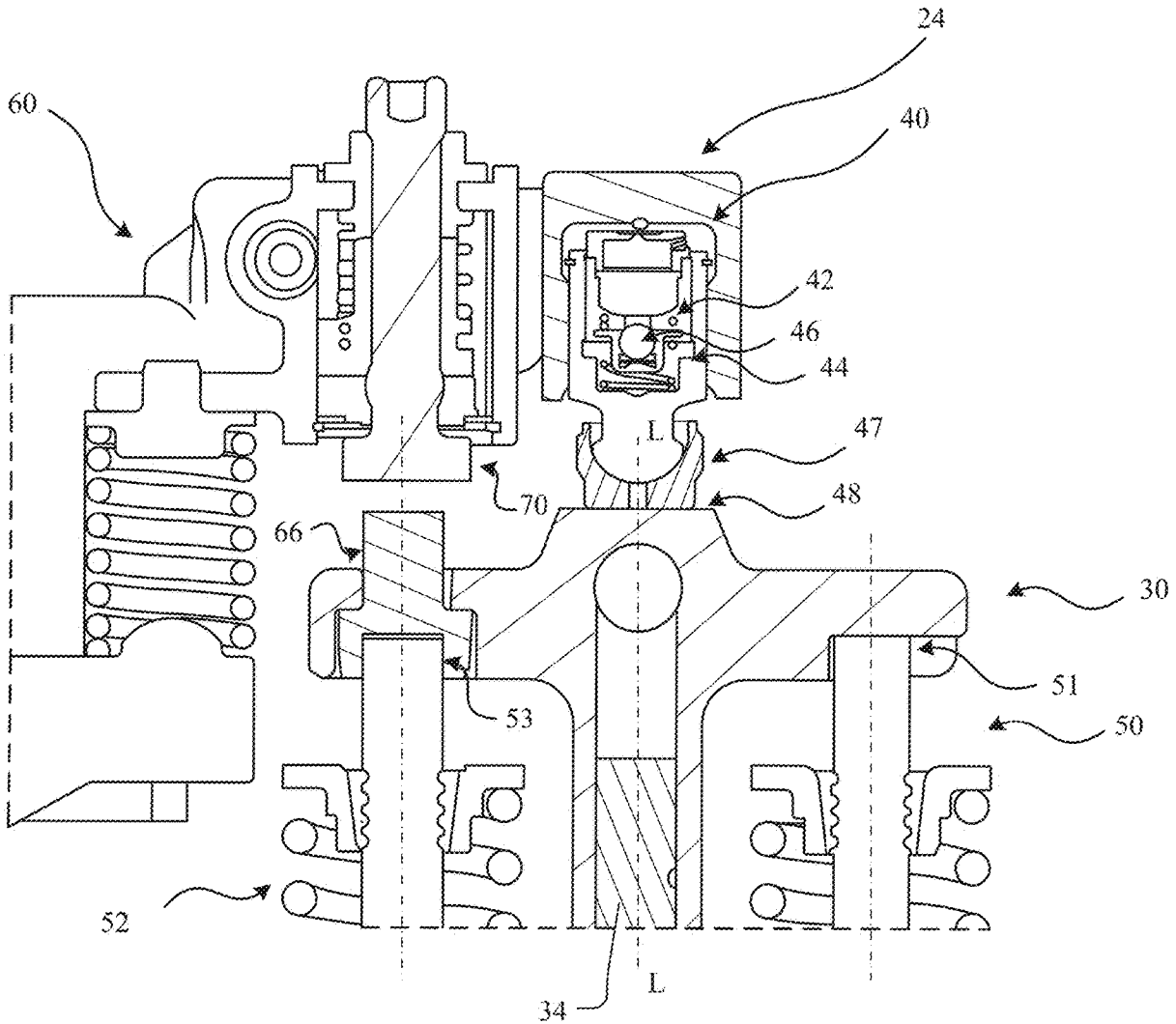
FIG. 2 illustrates a schematic enlarged partial sectional view of a valvetrain assembly having a dedicated engine braking rocker arm, also illustrating a valve bridge having a guided bridge arrangement, according to particular embodiments.

FIG. 2 illustrates a schematic enlarged partial sectional view of a valvetrain assembly 10 having a dedicated engine braking rocker arm 60, also illustrating a valve bridge 30 having a guided bridge arrangement, according to particular embodiments. Unlike the unguided valve bridge 30 illustrated in FIG. 1, in particular embodiments, valve bridge 30 may incorporate a guiding member 34, such as that illustrated in the non-limiting example of FIG. 2. In particular embodiments, guiding member 34 may comprise a coaxial member provided within valve bridge 30, such that valve bridge 30 may be supported, and/or its motion constrained, to solely translate along guiding member 34 along a valve opening direction L-L. In particular embodiments, valve bridge 30 may slide along, over, and/or about guiding member 34. In particular embodiments, therefore, by constraining its motion to be restricted along a valve opening direction L-L (i.e., only vertically, in the frame of reference of FIGS. 2-3), guiding member 34 may enable valve bridge 30 to remain level and/or horizontal under all operating conditions. In particular embodiments, therefore, guiding member 34 (or another suitable guiding member) may enable guided valve bridge 30 to oppose and/or prevent undesirable tilting by resisting any motion that is not aligned with a principal axis of translation along a valve opening direction L-L. In particular embodiments, guiding member 34, or an otherwise guided valve bridge 30, may separately or additionally enable the prevention of undesirable pumping up of HLA 40, such as to undesirably overcome a gap 74, as has been described herein. It should be appreciated that while particular means or aspects of providing a guided valve bridge in particular ways are described herein, this disclosure contemplates any suitable means of guiding valve bridge 30 in any suitable way.

FIG. 2 also illustrates a non-limiting example of hydraulic lash adjuster (HLA) 40 in further detail. According to particular embodiments, HLA 40 may be supplied with pressurized oil by one or more hydraulic lines (not shown) conveying hydraulic and/or control fluid, such as oil. By way of example and not limitation, a continuous supply of pressurized oil may be provided by an engine oil pump (not shown) and/or the engine's hydraulic fluid supply. In particular embodiments, a first HLA chamber, such as an upper HLA chamber 42, may function as a pressurized hydraulic fluid reservoir. In particular embodiments, a one-way valve, such as a check ball 46, may selectively restrict or permit hydraulic fluid flow between a first HLA chamber, such as upper HLA chamber 42, and a second HLA chamber, such as a lower HLA chamber 44. In particular embodiments, one or more HLA biasing elements, such as one or more springs, may be provided. In particular embodiments, an HLA plunger 47 may serve as an extendable member of HLA 40 for main exhaust rocker arm 20, such that exhaust rocker interface 48 may lie between HLA plunger 47 and valve bridge 30.

In operation, in particular embodiments, hydraulic or control fluid (such as oil) may selectively flow into lower HLA chamber 44 via a one-way valve, such as check ball 46, but may escape lower HLA chamber 44 only slowly, such as via one or more precise and very small leak surfaces, gates, or channels. Accordingly, in particular embodiments, HLA 40 may extend to accommodate or compensate for slack or lash in a exhaust rocker interface 48 between main exhaust rocker arm 20 and valve bridge 30, such that check ball 46 may open, and/or may allow lower HLA chamber 44 of the expanding hydraulic lash adjuster 40 to pull in oil from upper HLA chamber 42. Subsequently, after HLA 40 may have extended (in an action called "pumping up" of the HLA) to overcome any lash, check ball 46 may close based on the forces transferred from valve bridge 30 through HLA plunger 47, substantially trapping the relatively incompressible hydraulic fluid in lower HLA chamber 44. In other words, in particular embodiments, the trapped hydraulic fluid may prevent the plunger 47 being pushed inward (or upward, in the frame of reference of FIG. 2), so that HLA 40 may act as a solid body or nearly solid body for force transfer.

In particular embodiments, HLA 40 and/or HLA plunger 47 may be longitudinally aligned with exhaust rocker interface 48. As a non-limiting example, exhaust rocker interface 48 may longitudinally correspond to, or otherwise align with, a center of valve bridge 30, such that both valve 50 and 52 may be operated in parallel and/or in tandem based on valve bridge 30 being acted by main exhaust rocker arm 20 at exhaust rocker interface 48 in a kinematically suitable manner.

Figure 3:
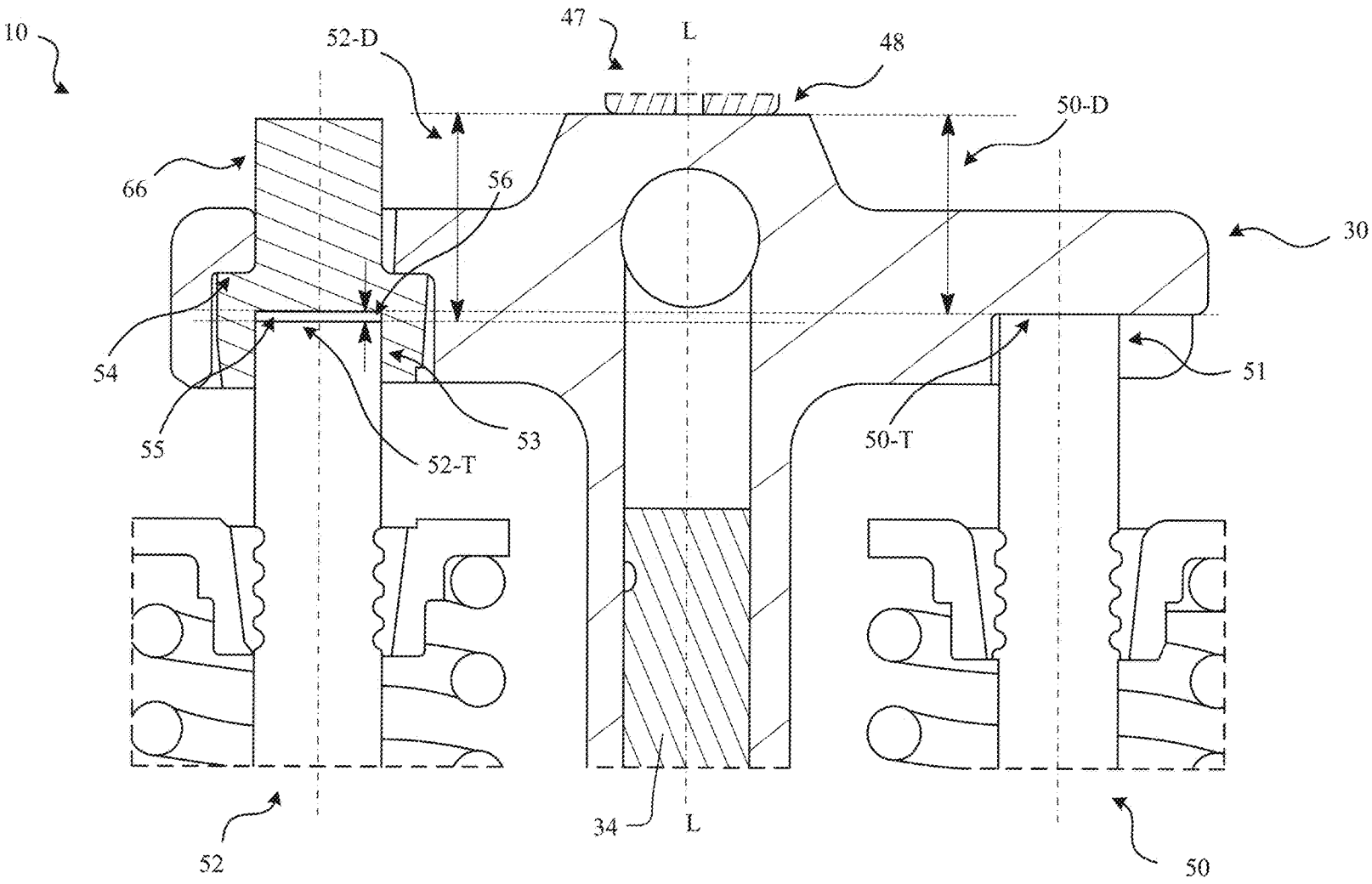
FIG. 3 illustrates a schematic enlarged partial sectional view of a valvetrain assembly having a dedicated engine braking rocker arm, illustrating a valve bridge having a guided bridge arrangement, also illustrating a relative arrangement of valve bridge contacting with a main exhaust valve and a brake valve, according to particular embodiments.

FIG. 3 illustrates a schematic enlarged partial sectional view of a valvetrain assembly 10 having a dedicated engine braking rocker arm 60, illustrating valve bridge 30 having a guided bridge arrangement, also illustrating a relative arrangement of valve bridge 30 contacting with main exhaust valve 50 and brake valve 52, according to particular embodiments.

As described previously, in particular embodiments of engine braking systems using a dedicated engine braking mechanism (such as an engine braking rocker arm 60), the use of hydraulic lash adjustment mechanism (such as HLA 40) may be challenging and/or precluded based on, for instance, undesirable pumping up of the hydraulic lash adjustment mechanism. In particular embodiments that may be provided with a guided arrangement for valve bridge 30, an undesirable tilting of valve bridge 30 may be prevented based on motion constraint applied by a suitable guiding mechanism, such as guiding member 34.

However, in particular embodiments of engine braking systems incorporating a guiding mechanism for valve bridge 30 as well as HLA 40, particular operational challenges and/or issues may remain that may render them mutually incompatible. As a non-limiting example, if brake valve 52 were configured, in a base circle position with both main exhaust and brake valves 50 and 52 closed, to be contacted preferentially by valve bridge 30 and/or set up to open first relative to main exhaust valve 50, then upon a dedicated valve opening event of brake valve 52 by engine braking rocker arm 60, valve bridge 30 may continue to reconfigure or resettle at a contact level along a valve opening direction L-L corresponding to main exhaust valve 50, such that a gap may open at exhaust rocker interface 48 (albeit now without a tilting of valve bridge 30). Accordingly, in particular embodiments, HLA 40 may then pump up, selectively extend, and/or otherwise act to fill the newly opened gap, which may then adversely affect the ability of the now-offset valve bridge 30 to provide correct valve timings, and/or may prevent full valve closing, among other undesirable effects. Stated differently, in particular embodiments, a presence of a guided bridge arrangement may be insufficient to preclude the use or compatibility of hydraulic lash adjustment mechanisms with dedicated engine braking mechanisms.

In a base circle position with main exhaust valve 50 and brake valve 52 both closed, with valve bridge 30 being a guided valve bridge, such as based on at least guiding member 34, particular inventive arrangements, configurations, and/or interoperations are described herein to provide compatibility of such dedicated engine braking mechanisms with hydraulic lash adjustment.

In particular embodiments, at base circle with both main exhaust and brake valves 50 and 52 closed, an inner valve-facing surface within main exhaust valve contact socket 51 of valve bridge 30 may either be in contact with a main exhaust valve (upper) contact surface 50-T, or there may be a gap or lash between them, as measured along a valve opening direction L-L. A corresponding main exhaust valve contact distance 50-D may be the distance between exhaust rocker interface 48 and main exhaust valve (upper) contact surface 50-T, as measured along valve opening direction L-L. In the former case of contact with respect to main exhaust valve 50 under said conditions, a valve opening force transfer path may be considered to immediately or already exist for opening main exhaust valve 50, in this configuration. In the latter case comprising a gap under said conditions, valve bridge 30 may need to traverse by the distance of the gap before a valve opening force may be transferred to open main exhaust valve 50.

In particular embodiments, a case comprising a gap or lash in the main exhaust valve opening force transfer path under said conditions may correspond to a configuration wherein valve bridge 30 may preferentially contact and/or first open brake valve 52 compared to main exhaust valve 50.

In particular embodiments, at base circle with both main exhaust and brake valves 50 and 52 closed, an inner bridge socket-facing surface within brake valve contact socket 53 of valve bridge 30 may either be in contact with a bridge socket shoulder 54, or there may be an upper gap or lash between them, as measured along a valve opening direction L-L. Separately or additionally, at base circle with both main exhaust and brake valves 50 and 52 closed, a bridge socket inner seat 55 within bridge socket 66 may either be in contact with a brake valve (upper) contact surface 52-T, or there may be a lower gap or lash between them, as measured along a valve opening direction L-L. A corresponding brake valve contact distance 52-D may be the distance between exhaust rocker interface 48 and brake valve (upper) contact surface 52-T, as measured along valve opening direction L-L. In the case of no gaps (i.e., neither upper nor lower gaps or lash, such as to correspond to full contact) with respect to brake valve 52 under said conditions, a valve opening force transfer path may be considered to immediately or already exist for opening brake valve 52, in this configuration. In the case comprising one or more gaps (i.e., either a lower gap, or an upper gap, or both upper and lower gaps) under said conditions, valve bridge 30 may need to traverse by the distance of the gap before a valve opening force may be transferred to open brake valve 52.

In particular embodiments, a case comprising a gap or lash in the brake valve opening force transfer path under said conditions may correspond to a configuration wherein valve bridge 30 may preferentially contact and/or first open main exhaust valve 50 compared to brake valve 52.

In particular embodiments, if gaps or lash were absent or eliminated from the respective force transfer paths for both main exhaust valve 50 and brake valve 52, such a situation may correspond to a configuration wherein valve bridge 30 may simultaneously contact and act on the main exhaust valve 50 and brake valve 52 when a valve opening force is applied.

With respect to the above discussion on the possibility of one or more gaps (measured along valve opening direction L-L) in the respective force transfer paths of main exhaust valve 50 and brake valve 52, it will appreciated that one or more gaps in the force transfer path of brake valve 52, if present or provided, may be distributed between multiple interfacing locations. As a non-limiting example, if one or more gaps were present or provided in the force transfer path of brake valve 52, in particular embodiments they may be distributed among the interfacing surface at or within bridge socket inner seat 55 (a lower gap being defined relative to an interfacing end of brake valve 52, i.e., brake valve (upper) contact surface 52-T, such as illustrated in FIG. 3), and the interfacing surface at or within brake valve contact socket 53 (gap defined relative to bridge socket shoulder 54), all gaps measured along valve opening direction L-L.

In particular embodiments, such as illustrated in the non-limiting example of FIG. 3, in a base circle position with main exhaust valve 50 and brake valve 52 both closed, valve bridge 30 may be configured to preferentially contact main exhaust valve 50 relative to brake valve 52. By way of illustration and not limitation, in particular embodiments, preferential contact of valve bridge 30 with main exhaust valve 50 may be provided by configuring a main exhaust valve contact distance 50-D to be shorter than a brake valve contact distance 52-D, such that a positive lash or gap 56 may be provided corresponding to a desired difference in length between the longer brake valve contact distance 52-D and the shorter main exhaust valve contact distance 50-D, each distance 50-D, 52-D, and gap 56 measured along valve opening direction L-L.

In particular embodiments, preferential contact of valve bridge 30 with main exhaust valve 50 may be provided by relatively configuring at least valve bridge 30, main exhaust valve 50, and brake valve 52 such that, in a base circle position with main exhaust valve 50 and brake valve 52 both closed, valve bridge 30 may "rest" on main exhaust valve 50.

In particular embodiments, preferential contact of valve bridge 30 with main exhaust valve 50 compared to brake valve 52 may be provided by relatively configuring valve bridge 30, main exhaust valve 50, and brake valve 52 such that, in a base circle position with main exhaust valve 50 and brake valve 52 both closed, one or more gaps may be provided in a brake valve opening force transfer path between exhaust rocker interface 48 and a corresponding interface of brake valve 52, such as brake valve (upper) contact surface 52-T, each distance and/or gap measured along valve opening direction L-L.

As a non-limiting illustration, in particular embodiments, in a base circle position with main exhaust valve 50 and brake valve 52 both closed, a preferential contact of valve bridge 30 with main exhaust valve 50 relative to brake valve 52, and/or providing a gap along the valve opening direction between valve bridge 30 and brake valve 52, may be provided by appropriately providing a tolerance stack-up within valvetrain system 10.

As a non-limiting example, in particular embodiments, an exhaust rocker interface 48 may be provided on valve bridge 30, such as by providing a top flat surface by milling or other suitable manufacturing and/or machining process. In particular embodiments, exhaust rocker interface 48 may be considered as a reference surface and/or datum for the tolerance stack-up. Further, in particular embodiments, a slot or cavity may be created corresponding to main exhaust valve contact socket 51, using a suitable manufacturing and/or machining process, such that a main exhaust valve contact distance 50-D may be defined between the exhaust rocker interface 48 and main exhaust valve (upper) contact surface, distance 50-D measured along valve opening direction L-L. Similarly, in particular embodiments, a tolerance stack-up along a brake valve opening force transfer path may be provided, which may incur a possibility of additional interfaces and/or tolerances relative to the force transfer path of main exhaust valve 50, based on at least an optional presence of bridge socket 66 in the path of brake valve 52. Consequently, in particular embodiments, a sum of tolerances of distances may be provided between exhaust rocker interface 48 and brake valve (upper) contact surface 52-T, such that, based on the tolerance stack-up as a non-limiting example, a lash or gap 56 may be provided within the valve opening force transfer path of brake valve 52, measured along valve opening direction L-L. As a non-limiting example, in particular embodiments, a tolerance stack-up analysis to provide a positive gap 56 may consider distances measured along valve opening direction L-L between exhaust rocker interface 48 on valve bridge 30, a (bottom) contacting surface within brake valve contact socket 53, an (upper) contacting surface of bridge socket shoulder 54, a (bottom) contacting surface within bridge socket inner seat 55, and/or an brake valve (upper) contact surface 52-T. In particular embodiments, if the force transfer path for both valves (main exhaust valve 50 and brake valve 52) include lash or gaps, then a tolerance stack-up may be used to suitably provide a larger gap on the brake valve opening force transfer path by a length corresponding to positive lash or gap 56, as measured along valve opening direction L-L.

In particular embodiments, by way of illustration and not limitation, a positive lash or gap 56 may be in the range of 0.02 mm to 0.7 mm. In particular embodiments, by way of illustration and not limitation, a positive lash or gap 56 may be in the range of 0.05 mm to 0.3 mm. In particular embodiments, by way of illustration and not limitation, a positive lash or gap 56 may be in the range of 0.1 mm to 0.2 mm.

Accordingly, in particular embodiments, in a base circle position with both main exhaust and brake valves 50 and 52 closed, valve bridge 30 may be guided to be constrained to be level and/or horizontal, and may rest on or be otherwise in initial and/or preferential contact with main exhaust valve 50. Consequently, in particular embodiments, a selective operation of brake valve 52 by engine braking rocker arm 60 in an engine brake mode may proceed without kinematically coupling with, or without otherwise affecting the relative configuration or arrangement of, valve bridge 30, hydraulic lash adjuster 40, and/or main exhaust valve 50, as desired. Upon re-engagement of a drive mode, main exhaust rocker arm 20 may proceed to operate both exhaust valves via valve bridge 30, as expected.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

Numerical ranges recited in this application should be construed to be inclusive of the end points of the stated ranges. Particular axes, such as one or more lateral and/or longitudinal axes, which may be omitted herein in some illustrations, should be construed to exist in every illustration or situation where it is referred to.

What is claimed:

1. A hydraulic lash adjustment-compatible added-motion engine braking system selectively operable in an engine brake mode and a drive mode, the engine braking system comprising:

an exhaust rocker arm assembly;

a main exhaust valve and a brake valve;

a valve bridge configured to selectively act on the main exhaust valve and the brake valve based on the exhaust rocker arm assembly acting on the valve bridge, a motion of the valve bridge constrained to be parallel to a valve opening direction;

a hydraulic lash adjuster (HLA) disposed on the exhaust rocker arm assembly, the HLA configured to selectively extend so as to automatically compensate for lash between the exhaust rocker arm assembly and the valve bridge; and an engine braking rocker arm assembly provided separately from the exhaust rocker arm assembly, the engine braking rocker arm assembly configured to selectively act on the brake valve in the engine brake mode, wherein, in a base circle position of the exhaust rocker arm assembly in which the main exhaust valve and the brake valve are closed, the valve bridge is configured to be in contact with the main exhaust valve and to provide at least one gap along the valve opening direction between the valve bridge and the brake valve such that the valve bridge first opens the main exhaust valve compared to the brake valve when the exhaust rocker arm assembly acts on the valve bridge.

2. The engine braking system of claim 1, wherein the valve bridge comprises a guiding member provided coaxially within the valve bridge and disposed parallel to the valve opening direction.

3. The engine braking system of claim 1, further comprising a bridge socket slidably disposed within a bore of the valve bridge, the bridge socket configured to enable access to the brake valve by the engine braking rocker arm assembly.

4. The engine braking system of claim 3, wherein the at least one gap along the valve opening direction is provided at a first interface disposed between the valve bridge and the bridge socket, and/or at a second interface disposed between the bridge socket and the brake valve.

5. The engine braking system of claim 1, wherein, in the engine brake mode, the valve bridge and the HLA are kinematically decoupled from a brake valve operation of the engine braking rocker arm assembly.

6. The engine braking system of claim 1, wherein the HLA is longitudinally aligned with a center of the valve bridge.

7. The engine braking system of claim 1, wherein the HLA contacts the valve bridge at an exhaust rocker interface, wherein a first distance, measured along the valve opening direction, between the exhaust rocker interface and an upper contact surface of the main exhaust valve is less than a second distance, measured along the valve opening direction, between the exhaust rocker interface and an upper contact surface of the brake valve.

8. A method of configuring an added-motion engine braking system to enable automatic hydraulic lash adjustment, the method comprising:

constraining a motion of a valve bridge to be parallel to a valve opening direction, the valve bridge configured to selectively act on a main exhaust valve and a brake valve based on an exhaust rocker arm assembly acting on the valve bridge;

configuring a hydraulic lash adjuster (HLA) disposed on the exhaust rocker arm assembly to selectively extend so as to automatically compensate for lash between the exhaust rocker arm assembly and the valve bridge;

configuring, in a base circle position of the exhaust rocker arm assembly in which the main exhaust valve and the brake valve are closed, the valve bridge to be in contact with the main exhaust valve and to provide at least one gap along the valve opening direction between the valve bridge and the brake valve such that the valve bridge first opens the main exhaust valve relative to the brake valve in response to the exhaust rocker arm assembly acting on the valve bridge; and configuring an engine braking rocker arm assembly to selectively act on the brake valve in an engine brake mode, the engine braking rocker arm assembly provided separately from the exhaust rocker arm assembly.

9. The method of claim 8, wherein the valve bridge comprises a guiding member provided coaxially within the valve bridge and disposed parallel to the valve opening direction.

10. The method of claim 8, further comprising configuring a bridge socket to enable access to the brake valve by the engine braking rocker arm assembly, the bridge socket slidably disposed within a bore of the valve bridge.

11. The method of claim 10, wherein the at least one gap along the valve opening direction is provided at a first interface disposed between the valve bridge and the bridge socket, and/or at a second interface disposed between the bridge socket and the brake valve.

12. The method of claim 10, wherein the valve bridge and the HLA are kinematically decoupled from a brake valve operation of the engine braking rocker arm assembly in the engine brake mode.

13. The method of claim 10, further comprising longitudinally aligning the HLA with a center of the valve bridge.

14. The method of claim 8, wherein the HLA contacts the valve bridge at an exhaust rocker interface, wherein a first distance, measured along the valve opening direction, between the exhaust rocker interface and an upper contact surface of the main exhaust valve is less than a second distance, measured along the valve opening direction, between the exhaust rocker interface and an upper contact surface of the brake valve.

15. A valvetrain system of an engine selectively operating in an engine brake mode and a drive mode, the valvetrain system comprising:

an exhaust camshaft including a main exhaust cam and a braking cam;

an exhaust rocker arm assembly operatively coupled to the main exhaust cam;

a main exhaust valve and a brake valve;

a valve bridge configured to selectively act on the main exhaust valve and the brake valve based on the exhaust rocker arm assembly acting on the valve bridge, a motion of the valve bridge constrained to be parallel to a valve opening direction;

a hydraulic lash adjuster (HLA) disposed on the exhaust rocker arm assembly, the HLA configured to selectively extend so as to automatically compensate for lash between the exhaust rocker arm assembly and the valve bridge; and an engine braking rocker arm assembly provided separately from the exhaust rocker arm assembly so as to be operatively coupled to the braking cam, the engine braking rocker arm assembly configured to selectively act on the brake valve in the engine brake mode, wherein, in a base circle position of the exhaust rocker arm assembly in which the main exhaust valve and the brake valve are closed, the valve bridge is configured to be in contact with the main exhaust valve and to provide at least one gap along the valve opening direction between the valve bridge and the brake valve such that the valve bridge first opens the main exhaust valve compared to the brake valve when the exhaust rocker arm assembly acts on the valve bridge.

16. The valvetrain system of claim 15, wherein the valve bridge comprises a guiding member provided coaxially within the valve bridge and disposed parallel to the valve opening direction.

17. The valvetrain system of claim 15, further comprising a bridge socket slidably disposed within a bore of the valve bridge, the bridge socket configured to enable access to the brake valve by the engine braking rocker arm assembly.

18. The valvetrain system of claim 15, further comprising a bridge socket slidably disposed within a bore of the valve bridge, the bridge socket configured to enable access to the brake valve by the engine braking rocker arm assembly, wherein the at least one gap along the valve opening direction is provided at a first interface disposed between the valve bridge and the bridge socket, and/or at a second interface disposed between the bridge socket and the brake valve.

19. The valvetrain system of claim 15, wherein, in the engine brake mode, the valve bridge and the HLA are kinematically decoupled from a brake valve operation of the engine braking rocker arm assembly.

20. The valvetrain system of claim 15, wherein the HLA is longitudinally aligned with a center of the valve bridge.

* * * * *